United States Patent [19]

Gregory

[11] Patent Number: 4,574,944

[45] Date of Patent: Mar. 11, 1986

[54] TRAY DEVICE FOR CONTACT LENSES

[76] Inventor: Frank A. Gregory, 3105 E. Skelly Dr., Ste. 301, Tulsa, Okla. 74105

[21] Appl. No.: 635,553

[22] Filed: Jul. 30, 1984

[51] Int. Cl.[4] ..... A45C 11/00; A45C 15/04; A45C 15/06; A45D 33/00; B65D 45/24

[52] U.S. Cl. ..... 206/5.1; 132/83 R; 206/38; 206/235; 220/335

[58] Field of Search ..... 206/5.1, 5, 38, 235; 132/83 R; 220/335

[56] References Cited

U.S. PATENT DOCUMENTS

| | | | |
|---|---|---|---|
| 2,779,344 | 1/1957 | Hemming et al. | 132/83 R |
| 3,089,500 | 5/1963 | Stalcup | 206/5.1 |
| 3,211,281 | 10/1965 | Speshyock et al. | 206/5 |
| 3,240,375 | 3/1966 | Burrows | 220/335 |

*Primary Examiner*—William T. Dixson, Jr.
*Attorney, Agent, or Firm*—Head, Johnson & Stevenson

[57] ABSTRACT

A total concept container for facilitating the use and care of contact lenses and comprising a first housing section providing a working area for use during the insertion and/or removal of a contact lens from the eye, the working area being particularly designed for capturing any liquids which may be dropped during the insertion or removal process and for protecting adjacent surfaces from accidental damage due to contact by the liquids, and a second housing section hingedly secured to the first housing section and having a mirror carried thereby, the second housing section being angularly adjustable with respect to the first housing section for orienting the mirror at the optimum position therefor for the user of the device when inserting and/or removing the contact lens from the eye, a light source may be provided for facilitating the use of the mirror, and the various liquids and other paraphernalia required in the use and care of contact lenses may be conveniently stored in the first housing section, if desired.

1 Claim, 5 Drawing Figures

TRAY DEVICE FOR CONTACT LENSES

BACKGROUND OF THE INVENTION

1. Field of the Invention

This invention relates to improvements in containers and more particularly, but not by way of limitation, to a total concept container providing for the efficient storage and utilization of paraphernalia used in connection with contact lenses as well as the contact lenses per se.

2. Description of the Prior Art

The use of contact lenses has become widespread and not only the use of the lenses but also the care thereof requires considerable attention and effort. For example, it is usually necessary to remove the lenses (with varying degrees of frequency) for cleaning and other treatment thereof, and the operations normally require the use of several different liquids. The accidental spillage of these liquids creates many problems. Of course, the relatively small size of the lenses creates another problem during the treatment procedures relating thereto in that they are frequently dropped or inadvertently lost, and the nature of the materials of construction of the lenses in combination with the size thereof renders them difficult to find when deposited on most available surfaces. It is normally necessary to clean the lenses before and after each use thereof, which again creates the problem of handling of the lenses and possible accidental loss thereof. The necessity of placing the lenses immediately over the cornea of the eye to insure that the lenses are properly positioned for proper vision is frequently a difficult procedure since this operation usually is required to utilize one hand for holding the lid of the eye open and the other for inserting and properly positioning the lens against the eyeball. Of course, the use of a mirror greatly facilitates this operation, but the position of the mirror for enhancing the viewing of the lens during the insertion operation may be critical. Of course, the occupation of both hands as required during the insertion operation creates a problem in the positioning of the mirror. It will be readily apparent that a proper convenient and consolidated storage site for all of the equipment or paraphernalia required in connection with the use and care of contact lenses in addition to a properly orientated mirror means is desirable.

There have been attempts to solve the many problems involved with the care and use of contact lenses, such as shown in the Croan U.S. Pat. No. 3,124,240, issued Mar. 10, 1964, and entitled "Contact Lens Case;" Stalcup U.S. Pat. No. 3,089,500, issued May. 14, 1963, and entitled "Contact Lens Carrying Case;" Bromberg U.S. Pat. No. 2,877,779, issued Mar. 17, 1959, and entitled "Case for Contact Lenses;" Barker, Jr. U.S. Pat. No. 3,178,015, issued Apr. 13, 1965, and entitled "Contact Lens Accessory;" Dalrymple U.S. Pat. No. 1,494,154, issued May. 13, 1924, and entitled "Vanity Case;" Grassi U.S. Pat. No. 2,424,817, issued July 29, 1947, and entitled "Compact or Vanity;" Brank U.S. Pat. No. 2,570,314, issued Oct. 9, 1951, and entitled "Compact;" and the Fagan U.S. Pat. No. 2,932,383, issued Apr. 12, 1960, and entitled "Support and Protective Receptacle for Contact Lens." The Croan, Stalcup, Fagan and Bromberg patents all relate to carrying or storage cases for contact lenses and do not provide for facilitating the utilization of the contact lens paraphernalia during the use and care of the lens. The Barker, Jr. patent discloses a contact lens accessory for facilitating the application or insertion of the contact lens into the eye by way of reducing the possibility of accidental loss of the lens. The Dalrymple, Grassi and Brand patents are directed to the well known vanity type compact structures which include a mirror, but are not related to the facilitating of the use and care of contact lenses.

SUMMARY OF THE INVENTION

The present invention contemplates a novel means for facilitating the storage, care and utilization of the paraphernalia required in connection with the use of contact lenses. The novel container is directed toward a total concept of care and use of contact lenses and comprises a combination of a bowlike device particularly designed and constructed of an appropriate size and configure for retaining a mirror in a proper upright position to enable the contact lens user to obtain a proper view of his eye during the insertion or removal of the lens, the mirror being so positioned without the necessity of the use of the hands of the user during the insertion or removal of the contact lens. In addition, a surface area is provided over which the contact lens wearer may insert, remove, treat, and clean the lenses with minimum danger that the lens will be lost, and means is provided to contain any excess liquids which may be spilled in the process of application of the liquids to the contact lenses, thus providing protection of dresser tops, table tops, clothing, or the like from damage due to spillage of the liquids normally used with the contact lenses. The novel total concept container for contact lenses and the paraphernalia associated therewith is simple and efficient in operation and economical and durable in construction.

DETAILED DESCRIPTION OF THE PREFERRED EMBODIMENT

Figure 1:
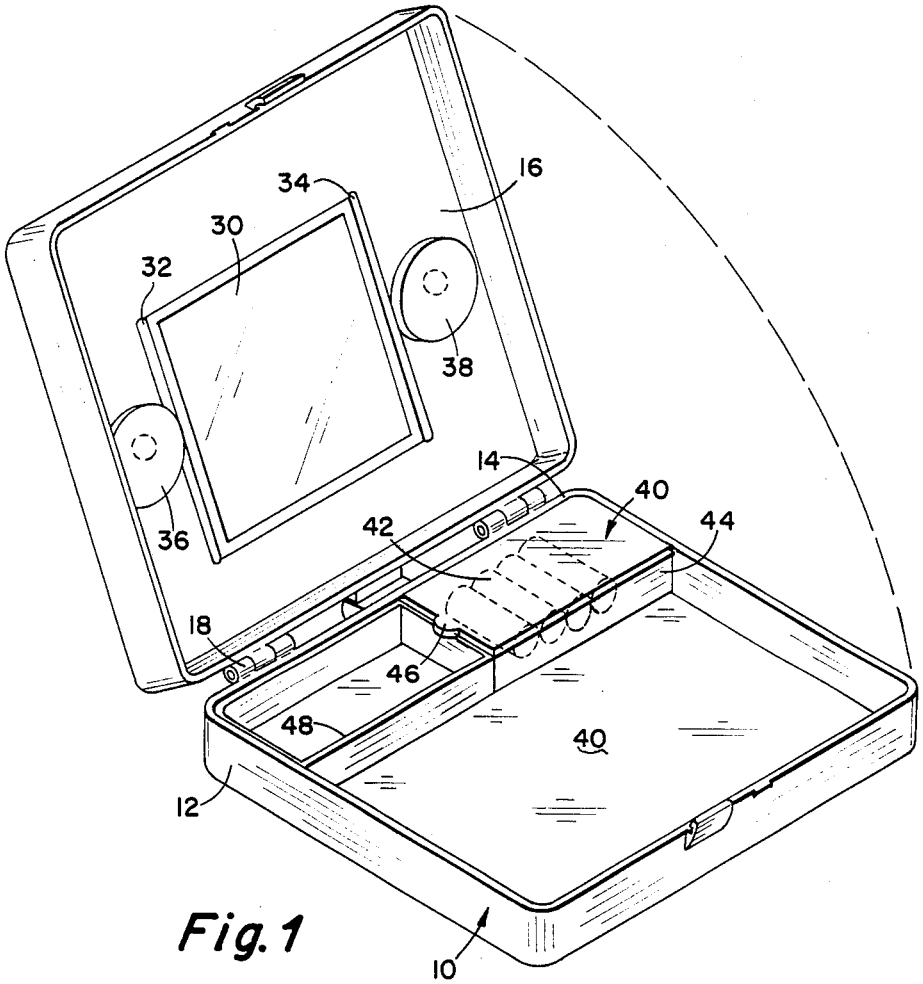
FIG. 1 is a perspective view of a total concept contact lens container embodying the invention.
Figure 2:
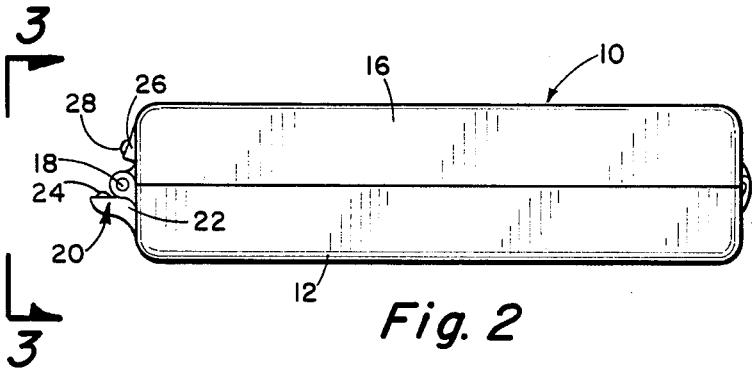
FIG. 2 is a side elevational view of a total concept contact lens container embodying the invention and depicted in a closed position.
Figure 5:
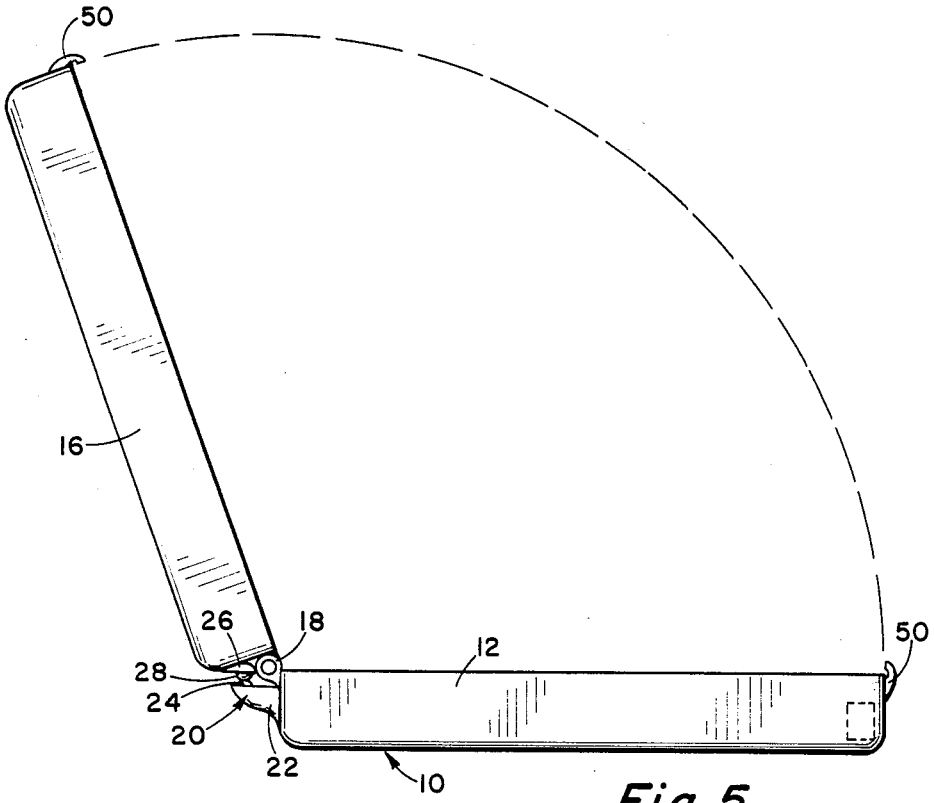
FIG. 5 is a side elevational view of a total concept contact lens container embodying the invention and depicted in an open operative position.
Figure 4:
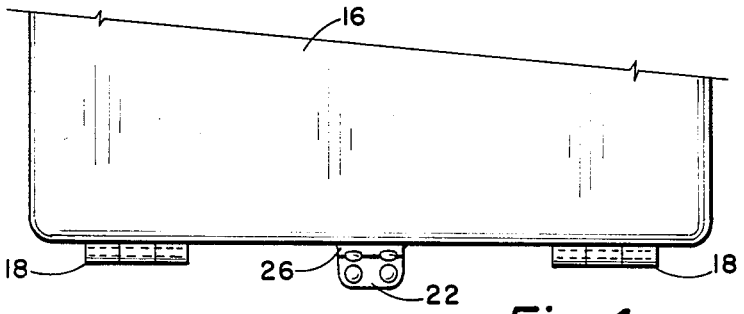
FIG. 4 is a broken view taken one line 4—4 of FIG. 2.
Figure 3:
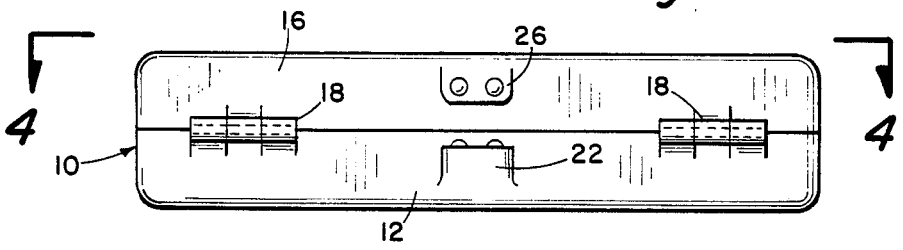
FIG. 3 is a view taken on line 3—3 of FIG. 2.

Referring to the drawings in detail, reference character 10 generally indicates a container comprising a first open housing section 12 having one side edge 14 thereof secured to a second open housing section 16 by suitable pivotal means, such as the hinge means 18 whereby the sections 12 and 16 may be positioned in a closed mutually engaged position, as shown in FIGS. 2 and 3, or an open position as shown in FIGS. 1 and 5. It is preferable to interpose suitable stop means 20 between the housing sections 12 and 16 whereby the section 16 may be moved to a preselected angular orientation with respect to the housing section 12 and retained in the selected position as desired and for a purpose as will be hereinafter set forth. Whereas the stop means 20 may be of substantially any desired construction, as shown herein the stop means 20 comprises an outwardly projecting element 22 provided on the outer periphery of the housing section 12 and extending in a direction toward the section 16, and having a stop or engagement button means 24 provided on the upper surface thereof as viewed in FIG. 5. A complementary outwardly projecting element 26 is provided on the outer periphery of the housing 16 in substantial alignment with the element 22 and is provided with a complementary engagement button means 28 adapted to come into contact with the button means 24 when the angular orientation of the housing section 16 with respect to the housing section 12 is achieved.

Whereas the housing sections 12 and 16 as depicted herein are of a substantially square or rectangular overall configuration, it is apparent that the outer configuration of the housings 12 and 16 may be substantially as desired. The inner surface of the housing section 16 may be provided with a suitable mirror means which becomes visible and usable upon opening of the housing 16 with respect to the housing section 12. The mirror means 30 may be permanently secured to the inner surface of the housing section 16 in any well known manner, if desired. Alternatively, the mirror means 30 may be removably secured thereto in an suitable manner, such as by providing a pair of spaced mutually parallel shoulders 32 and 34 spaced slightly outwardly from the inner surface of the housing 16 for receiving the opposite edges of the mirror means 30 therebetween. In addition, the mirror means may be of substantially any suitable construction. For example, the mirror means 30 may comprises the usual substantially flat mirror, or may be a magnifying mirror, or may comprise a standard flat mirror on one face thereof and magnifying mirror on the opposite face thereof, as desired. It is to be noted that the preselected angular orientation of the housing section 16 with respect to the housing section 12 is arranged to support the mirror means 30 at the optimum viewing angle for the user of the device 10 when inserting the usual contact lenses (not shown) or removing the lenses from his eye.

In addition, it may be desirable to provide suitable lighting means in association with the mirror means 30 for facilitating the use of the mirror means. As shown in FIG. 1, the lighting means may comprise a pair of light fixtures 36 and 38 mounted in the housing section 16 on the opposite sides of the mirror means 30, and operably engagable or connected with power source, as will be hereinafter set forth.

The inner surface 40 of the housing section 12 is preferably substantially flat or planar and constructed from a suitable non-porus material, but not limited thereto. The non-porus characteristic of the surface 40 will provide a surface which will hold any water or other liquids that may be used or escape from the user of the contact lenses during the insertion or removal thereof from the eye, or when cleaning or otherwise treating the contact lenses, and preclude the accidental loss of any of the liquids which might otherwise leak onto other surfaces. The sidewalls of the housing section 12 are sufficiently high as to retain any normal spillage of liquids which may occur during the use of the contact lenses, and further of substantially preclude any inadvertent washing of a contact lens from the surface 40 and onto another surface which might result in the loss or soiling of the contact lens. The planar or flat configuration of the surface 40 also facilitates the locating of any lens which might be inadvertently dropped onto the surface 40, thus providing for the relatively quick and easy retrieval of the lens. In addition, the flat surface 40 may be easily wiped clean or clear of any liquid which may accumulate thereon. It is also to be noted that the planar surface 40 may preferably be provided with a suitable texture for facilitating the retrieval of a contact lens which may inadvertently drop onto the surface 40.

If the lighted feature for the mirror means 30, or for any other reason, is desired, it may be preferable to provide a suitable power source such as generally indicated at 42 in FIG. 1. The power means may comprise a plurality of suitable batteries 42 properly secured or arranged within a suitable compartment 44 provided within the housing section 12. The compartment 44 may be provided with a suitable cover means 46 movable between open and closed position to provide access to the batteries 42 and to close the batteries 42 from the remaining portions of the housing section 12. In addition, it may be desirable to provide a removable housing or compartment section 48 adapted to be disposed within the housing section 12 for facilitating the storage of the normal paraphernalia (not shown) required during the use of the contact lenses (not shown). As shown in FIG. 1, the removable compartment 48 may be inserted in abutting relation with respect to the compartment 44 whereby the removable compartment 48 will be contained between the outer periphery of the compartment 44 and the inner periphery of the sidewalls of the housing 12. It will be understood, however, that the removable compartment 48 may be placed at any desired location within the housing section 12, and if desired, the removable compartment 48 may be permanent installation or an integral part of the housing section 12.

The housing sections 12 and 16 are preferably constructed from a suitable plastic material, such as plexiglas, or the like, but not limited thereto, and the surface 40 of the section 12 is preferably of a diverse color and/or brightness with respect to the usual contact lens for facilitating the visual sighting of any contact lens which may be placed or dropped thereon. As hereinbefore set forth, the housing section 16 is preferably of a rectangular or square configuration, and the planar size thereof is preferably or generally corresponding to the size of a human face, or somewhat larger. In addition, it may be desirable to secure the mirror means 30 to the inner surface of the housing 16 in such a manner that one edge of the mirror is pivotally secured to the housing 16. In this manner the angular position of the mirror may be altered with respect to the angular position of the section 16. This provides a substantially unlimited orientation for the mirror means 30 with respect to the face of the user for facilitating the insertion and/or removal of the contact lens from the eye. For example, if one of the horizontally arranged sides of the mirror 30 is pivotally secured to the section 16, the user of the apparatus 10 may lift the mirror to the position desired, and suitable means (not shown) may be provided for at least temporarily retaining the mirror in the adjusted position during use of the device 10.

Of course, suitable clasp means 50 is preferably provided for the apparatus 10 for cooperating between the housing sections 12 and 16 in the closed positions thereof for retaining the sections in the closed position when the apparatus 10 is not in use. It is also to be noted that the housing sections 12 and 16 may be so arranged as to be separable at the hinge connection therebetween in order to permit the use of both housing sections independent of one another if desired.

Of course, whereas the particular embodiment of the device 10 as shown herein includes a pair of housing sections hingedly secured together, it is to be noted that the two sections may be completely separate or independent of each other, if desired, and adapted to be placed together to provide a closed container, or moved apart for access to the interior of both sections. In addition, whereas the lighting means 36 and 38 shown herein is attached or secured in the proximity of the mirror means 30, it will be apparent that the light means may be installed in the removable chamber 48, if desired. Of course, it may also be desirable to place the power source 42 within the removable chamber 48, also if the light means is installed therein.

From the foregoing, it will be apparent that the present invention contemplates a total concept container for facilitating the use and care of contact lenses. The novel container includes mirror means which may be angularly adjusted for the optimum position thereof for the user during the insertion and/or removal of the contact lens from the eye. In addition, the novel container provides a "working area" particularly designed for catching and accumulating any liquids which may drop during the insertion and/or removal of the contact lens from the eye. Also, the working area is provided with a surface which has been particularly designed and constructed for facilitating the recovery of any contact lens which may be placed or inadvertently dropped thereon. The working area is also surrounded by sidewall means for confining any such liquids to the working area for protection of surrounding areas or surfaces from accidental damage due to contact thereof by the liquids. As an added feature, a light may be provided for facilitating the use of the mirror means, and compartment means or containers may be stored within the novel total concept container for storage of the liquids and other paraphernalia required in the overall use and care of contact lenses.

Whereas the present invention has been described in particular relation to the drawings attached hereto, it should be understood that other and further modifications, apart from those shown or suggested herein may be made within the spirit and scope of this invention.

What is claimed is:

1. A total concept container for the use and care of contact lenses comprising:

a first and second housing portion;

a working area provided in one of the housing portions whereby the contact lenses may be inserted into and removed from an eye in spaced relation over the working area;

a mirror provided in the other housing portion for facilitating the visual inspection during the inserting and removing of the contact lens from the eye, the first and second housing portion being hingedly secured together;

stop means cooperating between the first and second housing portions for retaining one of the housing portions in a preselected angular orientation with respect to the other housing portion wherein the working area comprises a substantially flat planar surface having sidewalls provided around the outer periphery thereof for accumulating and confining any liquid dropped during the inserting and removing of the contact lenses from an eye, and wherein the planar surface is of a contrasting color and texture with respect to the contact lenses for facilitating the recovering of a contact lense from any position on the surface; and lighting means secured to said other housing portion cooperating with said mirror for facilitating the use thereof.

* * * * *